US009468235B2

(12) United States Patent
Turlan-Van Der Hoeven et al.

(10) Patent No.: US 9,468,235 B2
(45) Date of Patent: Oct. 18, 2016

(54) SHEATHING KNITTED ELASTIC LOWER BODY GARMENT

(71) Applicant: HANES OPERATIONS EUROPE SAS, Rueil Malmaison (FR)

(72) Inventors: Manon Turlan-Van Der Hoeven, Marmagne (FR); Sylvain Houillon, Autun (FR)

(73) Assignee: Hanes Operations Europe SAS, Rueil Malmaison (FR)

( * ) Notice: Subject to any disclaimer, the term of this patent is extended or adjusted under 35 U.S.C. 154(b) by 142 days.

(21) Appl. No.: 14/383,666

(22) PCT Filed: Mar. 6, 2013

(86) PCT No.: PCT/FR2013/050477

§ 371 (c)(1),
(2) Date: Sep. 8, 2014

(87) PCT Pub. No.: WO2013/132188

PCT Pub. Date: Sep. 12, 2013

(65) Prior Publication Data

US 2015/0296894 A1 Oct. 22, 2015

(30) Foreign Application Priority Data

Mar. 7, 2012 (FR) ..... 12 52079

(51) Int. Cl.

| | |
|---|---|
| ***A41C 1/00*** | (2006.01) |
| ***D04B 1/24*** | (2006.01) |
| ***A41B 9/04*** | (2006.01) |

(52) U.S. Cl.

CPC ..... *A41C 1/003* (2013.01); *A41B 9/04* (2013.01); *D04B 1/243* (2013.01); *A41B 2500/10* (2013.01)

(58) Field of Classification Search

CPC ..... A41C 5/00; A41C 3/003; A41C 3/0007; A41D 2300/30–2300/32; A41D 7/00

USPC ..... 450/94, 109, 114, 116, 117, 122–126, 450/151, 153, 156

See application file for complete search history.

(56) References Cited

U.S. PATENT DOCUMENTS 2,196,492 A 4/1940 Clark et al.
4,701,964 A * 10/1987 Prunesti ..... A41C 1/003 2/406

(Continued)

FOREIGN PATENT DOCUMENTS

CN 1238939 12/1999
CN 101171378 4/2008

(Continued)

OTHER PUBLICATIONS

International Search Report issued Aug. 30, 2013 re: PCT/FR2013/050477; citing: U.S. Pat. No. 2,196,492 A, DE 21 51 624 A1, DE 199 42 996 A1 and EP 0 508 204 A1.

(Continued)

*Primary Examiner* — Gloria Hale
(74) *Attorney, Agent, or Firm* — Fish & Richardson P.C.

(57) ABSTRACT

The invention relates to a lower body garment comprising pants (1) with a knitted elastic base engaging with a network of rows of resin (7) applied to one surface of the elastic knit which forms the base of the pants, on the front and/or rear of the pants, characterized in that a knitted elastic lining (20) which is lighter than the base knit (5, 6) is provided in order to be applied freely to said surface of the base knit (5, 6) at least on said network of rows of resin (7).

22 Claims, 2 Drawing Sheets

(56) References Cited

U.S. PATENT DOCUMENTS

| | | | | |
|---|---|---|---|---|
| 4,916,755 | A * | 4/1990 | Feigenbaum | A41D 7/00 2/67 |
| 5,447,462 | A * | 9/1995 | Smith | A41C 1/003 2/73 |
| 5,465,594 | A | 11/1995 | Imboden et al. | |
| 5,916,829 | A * | 6/1999 | Girard | A41O 5/00 442/182 |
| 7,690,965 | B2 * | 4/2010 | Falla | A41C 3/0007 450/39 |

FOREIGN PATENT DOCUMENTS

| | | | |
|---|---|---|---|
| CN | 102083332 | | 6/2011 |
| DE | 2151624 | A1 | 5/1973 |
| DE | 19942996 | A1 | 3/2001 |
| EP | 0508204 | A1 | 10/1992 |
| EP | 2181613 | | 5/2010 |
| EP | 2181613 | A1 | 5/2010 |
| EP | 2193729 | B1 | 5/2011 |
| JP | 2003239105 | A | 8/2003 |
| TW | 200408357 | A | 6/2004 |

OTHER PUBLICATIONS

Chinese First Office Action, Chinese Application No. 2013800133647, Jun. 3, 2015, 7 pages.

* cited by examiner

SHEATHING KNITTED ELASTIC LOWER BODY GARMENT

CROSS-REFERENCE TO RELATED APPLICATIONS

This application is a U.S. National Phase Application under 35 U.S.C. §371 and claims the benefit of priority to International Application Serial No. PCT/FR2013/050477, filed on Mar. 6, 2013, which claims the benefit of priority to France International Application Serial No. FR1252079, filed on Mar. 7, 2012, the contents of which are hereby incorporated by reference.

TECHNICAL FIELD

The present invention relates to a knitted elastic lingerie article constituting a sheathing lower body garment, be it of the panties type or incorporated into a longer garment such as tights.

BACKGROUND

The purpose of sheathing garments is to provide comfort, well-being and pleasure when wearing them, while smoothing out unsightly bulges, smoothing and reshaping the body without restricting its movement.

In order to provide better support for the stomach at the front of the garment and buttocks at the back, it is known from the document U.S. Pat. No. 5,465,594 to knit (for example on circular loom) the part of the panties with different stitches and/or thread in particular at the plastron, leading to a certain complication of the knitting and a modification of the appearance of the knit which is not always desirable.

It is also known from the document EP 2181613, a lower body garment comprising a part of panties on which has been deposited a dense network of resin forming an elastic ring all around the pelvis for orthopedic or physical exercise purposes. On the one hand, it is not a sheathing garment. On the other hand, the network of resin lines considerably modifies the aspect of the garment, which is not necessarily suitable for users.

BRIEF SUMMARY

The purpose of the invention is to propose a sheathing lower body garment of modern appearance, smooth, and without a visible plastron.

The purpose of the invention is achieved by a lower body garment comprising panties with an elastic base knit engaging with a network of elastic resin applied on one surface of the knitted elastic base of the panties, in the front and/or at the back of the panties, characterized in that a knitted elastic lining lighter than the base knit is provided in order to be applied freely on said surface of the base knit at least at the place of said resin network, and preferably on the entire front or back surface, on which the resin network is deposited.

By elastic or elastomer resin network deposited on a surface of the garment, it is meant that the resin has been deposited so as to form lines that are more or less wide and more or less extended surfaces, which give a certain elastic compression in a preferential direction. These lines and surfaces form a network which may be more or less dense in places and absent in certain places of the garment surface.

In any case, the resin is not uniformly disposed on the entire surface of the garment, but only on a part thereof.

The surface where the resin is applied is preferably the inner surface and the lining is therefore internal, but a stylish effect can also be created by depositing the resin network on the outer surface of the base knit and by covering it with an outer lining.

Thanks to this constitution, in particular in cases of internal lining, the garment retains a perfectly uniform appearance from the outside, the resin network not being directly visible. The purpose of the inner lining is not to hide the resin network but to considerably increase comfort and reduce the risk of allergy and irritation. This very light mesh lining, for example of a specific weight of around 85 g/m$^2$, can even be translucent.

The inner or outer lining is advantageously applied with great freedom against the base knit layer, namely that it is not glued onto it over its entire surface, but simply attached substantially peripherally for example on a few points or lines, and for example preferably on the edges of the panties (waistband, leg openings).

Thanks to this lightweight lining, it is possible to use in a fairly significant manner resins that are usually avoided in the context of lingerie and in particular silicone rubbers of the rather tacky type. In fact, the silicone rubber is an interesting material due to its implementation and its natural elasticity; but until now, it's fairly large adherence made the use on the external surface of underwear undesirable in order to prevent snagging with the external garment, and the use on the internal surface of underwear also undesirable because of the unpleasant contact with the skin, allergy issues and sweating. The external or internal lining resolves these issues.

The resin network comprises a network of lines or surfaces of resin disposed on the front and/or at the back of the panties. In a particularly advantageous manner, when the network is only provided on one side (front or back) of the panties, it is completed on the other side by a compression band that allows creating around the panties a continuous ring of tension lines and obtaining interesting pulling and "push-up" effects. This compression band may advantageously be a heat-sealed textile band.

The lines of elastic resin disposed on a surface of the panties advantageously form a network which ends at the two lateral edges of said surface, at least in an (usually middle and/or upper) area of the edge; the ends of the band meet at the edges of the surface of the panties with the ending area of the resin lines disposed on the other surface. In this manner, the above-mentioned ring effect is obtained.

The elastic resin network lines are advantageously curved rather than straight.

On the front surface, the network of curved lines is composed of two symmetrical sets of lines going from the front of the thigh to the opposite hip, on the edge of the front surface, the two sets intersecting on the stomach.

On the back surface, the network of curved lines is composed of lines surrounding and enclosing the two inner zones of the gluteus maximus to join one edge with the other of the back surface of the panties.

The base knit of the article, at the panties, is made of a polyamide and elastane-based jersey mesh (preferably between 10% and 30% by weight of elastane with respect to the total weight of the knit). It advantageously exhibits an elongation of 15 Newtons (according to the BS 4952 standard) equal to or greater than 110%, at least in length. The specific weight of the knit at the panties is advantageously in the range of 150 to 200 g/m$^2$ (ISO 3801 standard).

The lining is advantageously a lightweight mesh of which the specific weight ranges between 60 and 100 g/m$^2$ and the elongation, at least in one direction, is equal to or greater than that of the base knit.

The silicone is advantageously a bicomponent HTV silicone. Its Shore A hardness advantageously ranges between 10 and 40.

BRIEF DESCRIPTION OF THE DRAWINGS

Other features and advantages of the invention will become apparent from the following description of two particular embodiment examples. Reference will made to the accompanying drawings in which.

DETAILED DESCRIPTION

Figure 1A:
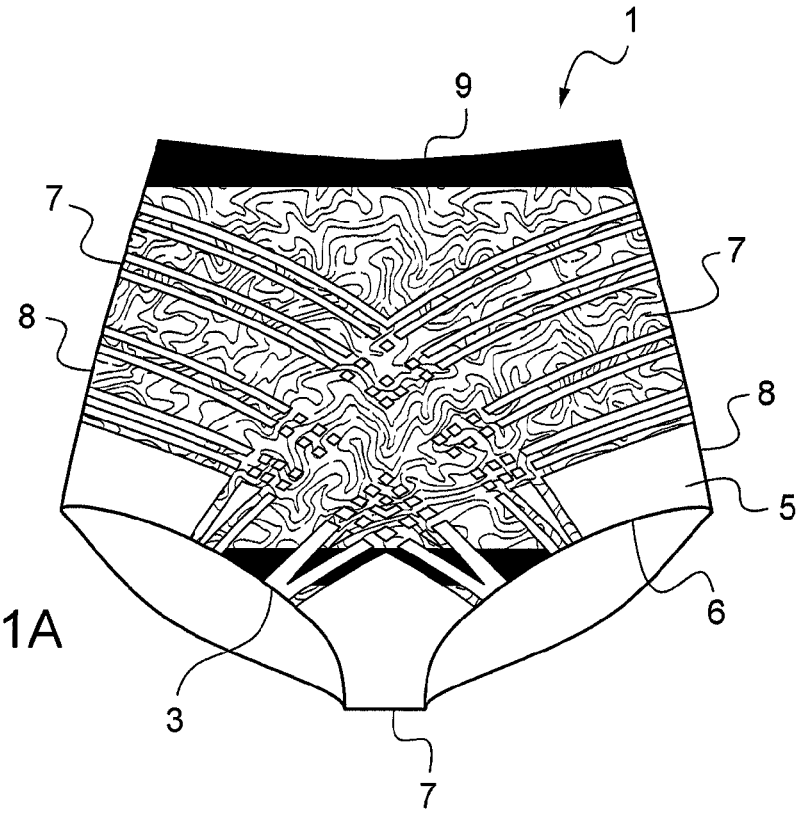
FIGS. 1A and 1B are front and rear views of a first embodiment example of panties in accordance with the invention, the lines of resin and compression bands being represented visible as if the base knit was transparent.
Figure 1B:
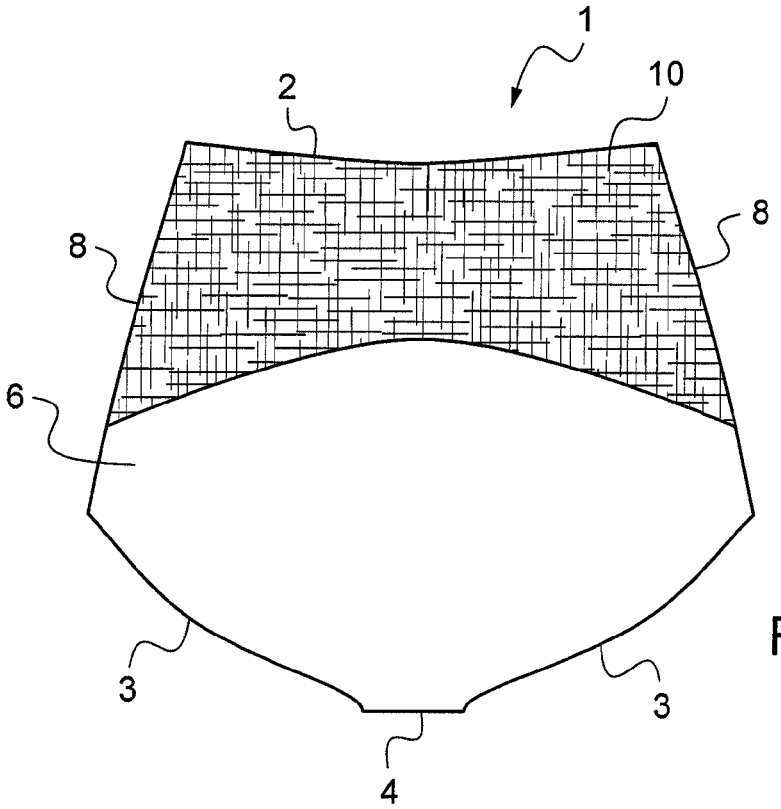

FIGS. 1A and 1B show the front and back of panties 1 according to the invention, which typically includes an upper opening 2 for the torso and two lower openings 3 for passage of the thigh (or leg). The panties 1 can be knitted in a circular loom and can be seamless (except possibly at the crotch part 4); alternatively, it may comprise two front and back panels knitted in a rectilinear loom and sewn. The knit is elastic. The upper opening 2 comprises an elastic belt, not shown, which may itself be obtained in any known manner, for example by complete knitting or sewing, gluing, by heat-sealing an added elastic part, textile or otherwise, or by applying an elastic resin.

The panties 1 are for example knitted in a jersey mesh charmeuse with rows of polyamide thread wrapped with elastane alternating with rows of non-wrapped polyamide. The proportion of elastane in the knit is around 21% and the specific weight of the knit is 185 g/m$^2$ and its elongation is 130% in the direction corresponding to the width of the panties.

The front 5 of the panties is covered in places by a network of silicone rubber according to a particular geometry in which are substantially distinguished two intersecting sets of more or less wide curved lines 7 ranging from the upper and middle area of a lateral edge 8 of the panties 1 to the opposite thigh opening 3, substantially towards the middle of the front of the thigh opening. These intersecting and oblique lines 7 may have several widths and both form a decorative pattern at the same time they provide some elastic compression. These lines 7 may possibly be complemented by an upper stomach panel 9 which extends under the belt between the two lateral edges 8 and falls to a point towards the middle.

In fact, these lines 7 and this panel 9 which have been represented visible on FIG. 1A are applied on the inner surface of the front 5 and are hence not visible from the outside of the panties. The figures represent in short panties which have been turned surface inside out.

The back 6 of the panties 1 comprises a band of compression material 10 that goes from edge 8 to edge 8, at the same middle and upper part of the edge 8 at which end the intersecting lines 7 in the front and the upper panel 9. This band of compression material 10 may be made from a deposited silicone rubber, but, in a more economical manner, it may be a band of textile compression material laminated on the surface 6 (for example with dots of polyamide adhesive).

Here again, the compression band 10 has been represented visible on FIG. 1B, but it is preferably applied on the inner surface of the back 6 and is not visible from the outside of the panties 1. However, it is also possible to provide it on the external surface of the back 6 in as far as it is not likely to interfere with the garments if made of a textile band and not a silicone one.

In a particular embodiment example, the compression band 10 is made by heat bonding of a yoke made of the same material as the base knit, of which it hence comes to double the thickness.

The set of intersecting lines 7 and the back compression band 10 form a sort of elastic intersecting loop which acts effectively to maintain the abdomen. The lines 7 start from the left thigh, they rise towards the waist in a fluid curve to end at the right side. The lines 7 are lined mirrored in order to adopt the same disposition symmetrically from the right thigh to the waist on the left side. As represented, the lines 7 are preferably curved, for example downwardly concave, the curved lines being in fact more flexible and comfortable than straight lines. The curved lines 7 intersect on the stomach where they act to the maximum because the amount of silicone rubber deposited on the material is therefore more concentrated therein. The lines 7 are of different widths (4 mm to 40 mm) and spaced apart (from 2 to 6 mm), the widest line being in the example represented in the center of the lines 7.

Figure 3:
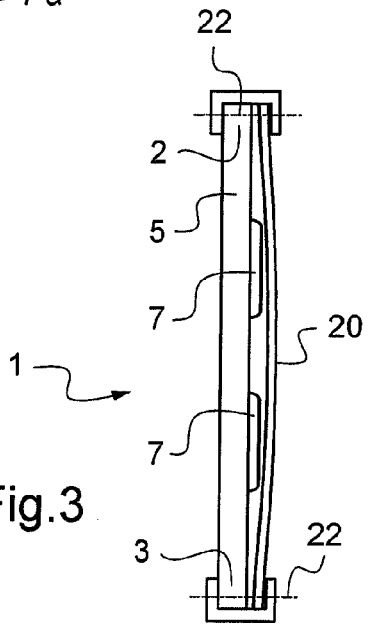
FIG. 3 is a schematic sectional view of the layers forming the panties of the invention.

FIG. 3 schematically shows a section of the front of the panties 1 with the knit forming the front 5 on which are applied lines or surfaces 7 of silicone rubber, preferably on the internal surface of the front. These applications penetrate very slightly into the knit 5 and do not pass through it, so that they are not directly visible from the other side of the knit 5. Above the base knit 5, a lightweight internal lining 20 has been disposed free over most of the surface, in any case facing the network of intersecting lines 7. The lining is attached to the base knit for example at the upper and lower borders corresponding to the torso opening 2 and leg opening 3. The attachment can be done for example by bonding in a manner known per se, with a glued or stitched added collar 21, and/or by topstitching 22. Preferably, the lining 20 is provided over the entire front surface, on the inside, and can also be provided on the entire back surface although it not being technically essential where there is no silicone.

The lining is a mesh including 10% elastane for a specific weight of the knit of 85 g/m$^2$. Its elongation is of 145% in the direction corresponding to the width of the panties.

The silicone rubber is in a particular example a silicone (polydimethylsiloxane with vinyl groups and auxiliaries) of the Elastosil® brand and of LR 3003/10 grade from Wacker, curable under heat, and bicomponent (A+B). The silicone is screen printed on one surface of the panties and heat polymerized (for example 175° C. for 30 seconds under infrareds, other heating methods being of course possible).

The thickness of deposited silicone is about 0.20 to 0.25 mm (a thickness in the range of that of the base knit), which for the various sizes of considered panties represents a total weight of 16 g to 23 g.

Various measurements of maximum elongation A were carried out (in the width direction of the panties, unless otherwise specified), of the return force F, as well as the return force F30 at 30% elongation for different combinations of layers including the base knit (T), the lining (D), the base knit+silicone (TS), the base knit+compression band (TC):

| | | | |
|---|---|---|---|
| T | A = 130% | F = 425 cN at 80% | F30 = 200 cN |
| D | A = 145% | F = 195 cN at 80% | F30 = 100 cN |
| TS | A = 61% | F = 1191 cN at 50% | F30 = 1000 cN |
| TS + D | A = 47% | | F30 = 939 cN |
| TC | A = 40% | | F30 = 828 cN |

These measurements show that with the application of silicone, the base knit retains an elongation of 61% and has become five times more nervous (this is what F30 indicates). The material is hence far from rigid. Therefore, the article is easier to pull on and the material moves with the body while compressing the stomach and waist.

The impact of the addition of the lining on the elongation and nervousness of the raw material with the application of silicone is very small. However, as mentioned above, its protective role is essential.

The measurements of the elongation and nervousness of the complex on the back side at the waist and hips are in the continuity of those found on the front sides of the product. The draw starts from the left thigh, rises, crosses the stomach to the right side at the waist and joins the yoke on the back, which takes over and goes around the back. On the other side of the waist (left front) new lines of silicone take over to pull the stomach such an elastic bandage ending on the right thigh.

Figure 2A:
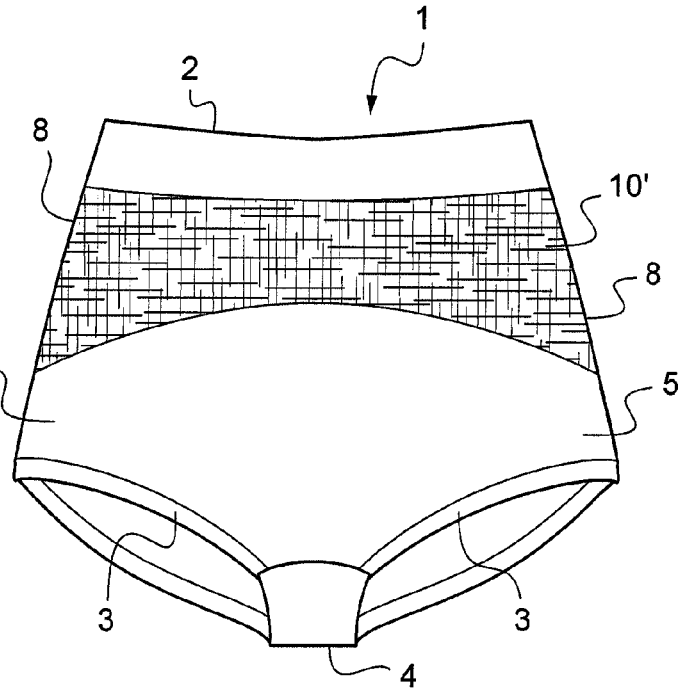
FIGS. 2A and 2B are front and rear views of a second embodiment example of the panties in accordance with the invention, the lines of resin and compression bands being represented visible as if the base knit was transparent.
Figure 2B:
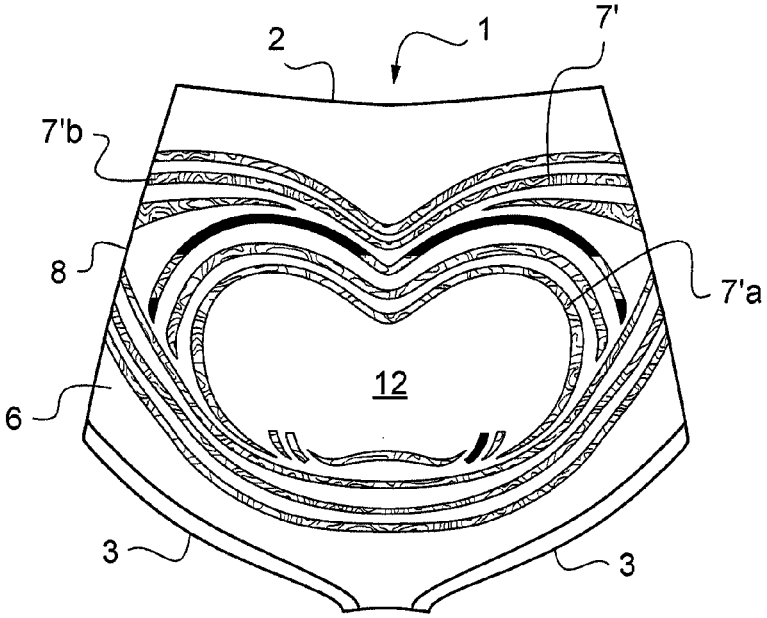

FIGS. 2A and 2B show another embodiment in which the silicone is applied to the back of the panties to obtain a buttocks lift effect. In this case, the back part 6 of the panties 1 comprises, on its internal surface a network of curved lines 7' of silicone rubber which are here disposed so as to surround the area 12 in the shape of an ossicle or kidney, and substantially corresponding to the internal zone of the gluteus maximus. Some of the curved lines 7' almost entirely surround the zone 12, such as the line 7'*a*, others border the zone more widely and join the opposite edges 8, such as the lines 7'*b*.

All the lines 7' ending at the edges 8 end therein in a median zone of the edge 8 where the elastic tensile stresses are taken to the other side of the panties, that is to say, in the front 5, by a compression band 10' similar to the band 10 of FIG. 1B and possibly concave on its lower part in the same way. As in the previous embodiment, a lightweight lining is provided, intended to be disposed freely at least in front of the networks of lines 7', that is to say, on the back part of the panties. The lining may also extend over the entire panties.

The zone 12 (at least its lower part) and the neighboring lines of silicone 7' at the bottom of the zone 12 are advantageously disposed in a rounded thermoforming mold to give a shape to the back part of the panties. During this operation, only the fabric takes the curved form, the silicone retaining its memory of previous form.

Wearing tests were conducted with the two embodiments and have shown 100% satisfaction on the part of users.

It has been described here separate panties but the invention can be applied to the panties part of a longer garment and even tights.

The invention claimed is:

1. A lower body garment comprising panties with an elastic base knit engaging with a network of elastic resin applied on one surface of the elastic base knit of the panties on at least one of the front or back of the panties, the network of elastic resin forming curved resin lines on the surface of the elastic base knit of the panties, wherein a knitted elastic lining lighter in weight than the base knit is provided to be attached to said surface of the base knit, wherein the knitted elastic lining covers at least a location of said resin network.

2. The garment according to claim 1, wherein the surface of the base knit on which the resin network is applied is the inner surface.

3. The garment according to claim 1, wherein the knitted elastic lining attached to the surface of the base knit on which the network of elastic resin is deposited is applied over an entirety of the surface of the base knit.

4. The garment according to claim 1, wherein the lining is attached to the surface of the base knit at least at a portion of a periphery of the lining.

5. The garment according to claim 1, wherein the lining is made of a lightweight mesh of 60 to 100 g/m$^2$.

6. The garment according to claim 1, wherein the elastic resin is a silicone rubber.

7. The garment according to claim 1, wherein the network of elastic resin comprising the curved lines is provided on one side of the panties, and is completed on the other side by a compression band extending across the other side of the panties, which forms around the panties a continuous ring of tension lines.

8. The garment according to claim 7, wherein the compression band is a heat-sealed textile band.

9. The garment according claim 7, wherein curved resin lines disposed on the side of the panties extend between two lateral edges of the side of the panties, the two lateral edges being at intersections of the side of the panties with the other side of the panties at lateral sides of the panties, wherein at least in one area of the two edges where ends of the compression band join at the two edges on the opposite surface of the panties connect with an ending area of the curved resin lines disposed on the surface of the base knit on the side of the panties.

10. The garment according to 1, wherein on the front surface of the panties, the network of elastic resin comprising curved lines comprises two symmetrical sets of lines going from the front of a thigh of a wearer of the garment to an opposite hip of the wearer, on an edge of the front surface, the two sets intersecting on a stomach of the wearer.

11. The garment according to claim 1, wherein on a back surface of the panties, the network of elastic resin comprising the curved lines surrounds and encloses two internal zones of a gluteus maximus of a wearer of the garment in order to join one lateral edge with another lateral edge of the back surface.

12. The garment of claim 5, wherein the mesh comprises 10% elastane and an elongation of 145% in the direction corresponding to a width of the panties.

13. The garment of claim 6, wherein the silicon rubber penetrates slightly into the base knit and does not pass through the base knit so that the silicon rubber is not directly visible from the other side of the base knit.

14. The garment of claim 10, wherein the resin lines deposited on the base knit are more concentrated on the stomach than a remainder of the resin lines.

15. The garment according to claim 1, wherein the base knit comprises a jersey knit mesh comprising rows of polyamide thread wrapped with elastane alternating with rows of non-wrapped polyamide, where an elongation of the base knit is 130% in the direction corresponding to a width of the panties.

16. A lower body garment comprising:

an elastic base knit forming panties;

a network of elastic resin applied on a surface of the elastic base knit on at least one of the front or back of the elastic base knit forming the panties, the network of elastic resin comprising curved lines of the elastic resin on the surface of the elastic base knit; and a lining attached to the elastic base knit and covering at least a portion of the network of elastic resin.

17. The garment of to claim 16, wherein the network of elastic resin is applied on an inner surface of the base knit.

18. The garment of to claim 16, wherein the lining is a knitted elastic lining that is lighter in weight than the elastic base knit.

19. The garment of claim 16, wherein the lining covers an entirety of the network of elastic resin, and is attached to the surface of the base knit at least at a portion of a periphery of the lining.

20. The garment of to claim 16, wherein the network of elastic resin comprises silicone rubber.

21. The garment of claim 20, wherein the silicon rubber penetrates slightly into the base knit and does not pass through the base knit so that the silicon rubber is not directly visible from the other side of the base knit.

22. The garment of claim 16, wherein the network of elastic resin forms lines of the elastic resin on a first side of the panties and a compression band extending across a second, opposite side of the panties, the lines of elastic resin and the compression band forming a continuous ring of tension lines around the panties.

* * * * *